United States Patent [19]

Fernandez

[11] 4,436,305

[45] Mar. 13, 1984

[54] COMPOSITE REINFORCED RACKET STRUCTURE

[75] Inventor: David Fernandez, Camarillo, Calif.

[73] Assignee: American Sports Equipment, Camarillo, Calif.

[21] Appl. No.: 296,255

[22] Filed: Aug. 26, 1981

[51] Int. Cl.[3] ..... A63B 49/02; A63B 49/12

[52] U.S. Cl. ..... 273/73 C; 273/73 D; 273/73 G; 273/73 H; 273/73 J; 273/DIG. 23

[58] Field of Search ..... 273/73 R, 73 J, 73 F, 273/73 C, DIG. 23, 82 A, 73 D

[56] References Cited

U.S. PATENT DOCUMENTS

| | | | |
|---|---|---|---|
| 833,882 | 10/1906 | Le Fevre | 273/82 A |
| 3,702,189 | 3/1971 | Galich | 273/73 C |
| 3,787,051 | 1/1974 | Johns | 273/73 F |
| 3,810,620 | 5/1974 | Decker et al. | 273/73 J |
| 3,840,230 | 10/1974 | Schaefer | 273/DIG. 7 |
| 3,899,172 | 8/1975 | Vaughn et al. | 273/73 C |
| 4,220,335 | 9/1980 | Nobbs | 273/73 R |

FOREIGN PATENT DOCUMENTS

| | | | |
|---|---|---|---|
| 1442020 | 5/1966 | France | 273/73 D |

*Primary Examiner*—Richard C. Pinkham
*Assistant Examiner*—Matthew L. Schneider
*Attorney, Agent, or Firm*—Poms, Smith, Lande & Rose

[57] ABSTRACT

A frame structure adapted for use as a tennis racket. The frame structure includes a frame body made from either wood, metal or plastic having a tubular structure with inside and outside surfaces. A composite material jacket having an outer layer adjacent and bonded to the frame outside surface and an inner layer adjacent and bonded to the frame body inside surface is provided. The composite material jacket is made from composite materials such as resin impregnated boron, graphite, polyamide aromatic and glass fibers. In addition, plastic throat pieces commonly used to connect and support racket necks and handles are replaced by composite material cross-member supports which are integrally molded to the composite material jacket. The composite material jacket provides structural reinforcement as well as desirable shock and vibration dampening characteristics. In addition, the tubular frame is provided with elongated slots through which racket strings are attached for mounting. The composite material jacket when molded into place on the frame structure fills these slots with cured composite material thus providing a ribbed integral connection between the outer and inner jacket layers. Holes provided through these ribbed sections have cross-sectional areas smaller than the elongated slots thereby preventing undesirable contact of the racket strings passing therethrough with the metal frame structure.

10 Claims, 12 Drawing Figures

COMPOSITE REINFORCED RACKET STRUCTURE

BACKGROUND OF THE INVENTION

The present invention relates generally to improving metal, wood and plastic tennis rackets. More particularly, the present invention relates to an improved tennis racket structure in which composite materials are utilized in combination with these conventional frame structures to provide an improved tennis racket having increased strength, better play characteristics and resistance to breakage.

There is presently a wide variety of tennis rackets available to today's tennis player. These tennis rackets are made from various different materials and are available in numerous different sizes, weights and configurations. Typically, tennis rackets are made from wood, metal, various strong plastics and more recently from resin impregnated composite fiber material.

Metal tennis rackets are generally made from lightweight metals such as aluminum and aluminum alloys. Typically, the metal is formed into strong tubular structures having various cross-sectional configurations designed for strength. The racket is made by bending or otherwise suitably shaping the tube into the desired racket shape. Oversized holes are then provided in the head portion of the racket through which the racket strings are passed for mounting. In order to prevent cutting of the nylon or gut stringing by contact with the metal frame over a period of time, plastic grommet strips are inserted into the oversized holes to provide a suitable mounting surface for the racket strings. In addition, one or more plastic throat pieces or cross-member supports are provided between the metal tubes in the neck portion of the racket. These plastic support pieces are either riveted or held by screws to each side of the frame. In addition, a plastic frontcap must be provided to seal or support the members used to form the handle.

Tubular metal racket frames have experienced popularity since they are relatively inexpensive to manufacture and provide a lightweight, strong tennis racket.

Even though tubular metal frame rackets are well suited for their intended purpose, they do have some inherent undesirable characteristics. Tennis players in general have acknowledged that these disadvantages include high shock and vibration transmission, lack of control when tennis ball hits are slightly off center, and in addition the rackets provide a general harsh feel which tends to aggravate common tennis injuries such as tennis elbow. In addition, the plastic components of the metal frames are subject to breakage thereby reducing racket life.

Accordingly, it would be desirable to provide an improved metal tennis racket frame which eliminates the plastic grommet strip and plastic throat members, further, it would be desirable to provide an improved racket structure which attenuates shock and vibration transmission to reduce the harsh feel of the racket structure.

SUMMARY OF THE INVENTION

In accordance with the present invention, an improved tennis racket frame is provided wherein all of the above discussed desirable racket characteristics are provided. The present invention is based upon a frame structure which includes a frame body made from either wood, metal or plastic. The frame body includes inside and outside surfaces. According to the present invention, a composite material jacket having an outer layer adjacent and bonded to the frame body outside surface and an inner layer adjacent and bonded to said frame body inside surface is provided. This composite material jacket may be made from any of the well known composite materials such as resin impregnated boron, graphite, polyamide aramid and glass fibers. The composite material jacket provides structural reinforcement as well as desirable shock and vibration dampening characteristics. The composite materials are also highly resistant to breakage.

As a particular feature of the present invention, the plastic throat pieces commonly used to connect or support the racket neck and handle are replaced by composite material cross-member supports which are integrally molded to the composite material jacket.

As another feature of the present invention, the tubular metal frame is provided with elongated slots through which the strings are attached for mounting. The composite material jacket when molded into place on the frame structure fills these slots with cured composite material thus providing a ribbed integral connection between the outer and inner jacket layers. String holes are provided through these ribbed sections. These string holes have a smaller cross-section than the elongated slots within the metal tubular frame and are centrally located thereby preventing undesirable contact of the racket strings with the metal frame. In addition, slots may be provided in other locations along the frame body to provide direct integral molded connection of the inner and outer jacket layers. The composite ribs formed in these locations are not drilled. This is especially useful in the racket neck or yoke area where optimum structural strength and connection of the jacket layers is desirable.

The above discussed and many other features and attendant advantages of the present invention will become apparent as the invention becomes better understood by reference to the following detailed description when considered in conjunction with the accompanying drawings.

BRIEF DESCRIPTION OF THE DRAWINGS

FIG. 10 represents the positioning of the frame body and composite material jacket within a conventional mold.

DETAILED DESCRIPTION OF THE INVENTION

The present invention has a wide range of applications for reinforcing tubular frame bodies made from a variety of materials including light weight metals, various wood structures as well as plastics. The present invention has particular application to frame structures adapted for use as tennis rackets. The following detailed description will therefore be limited to a preferred exemplary tennis racket frame produced in accordance with the present invention.

Figure 1:
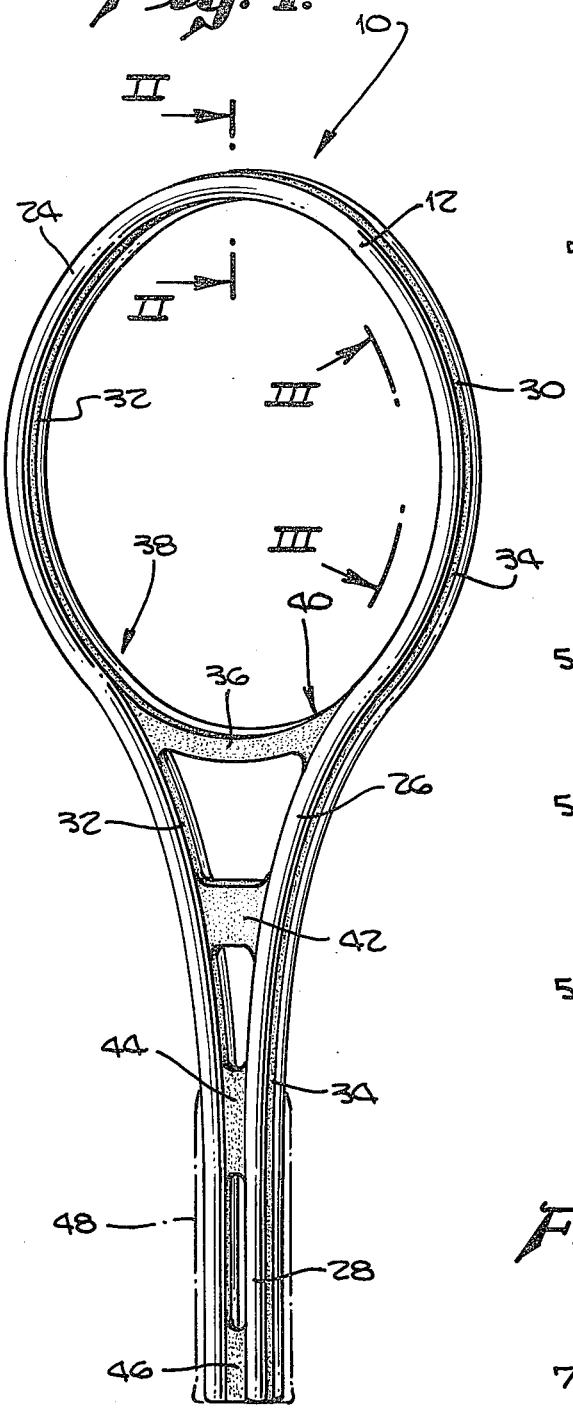
FIG. 1 is a perspective view of a preferred racket in accordance with the present invention.

An exemplary tennis racket frame in accordance with the present invention is shown generally at 10 in FIG. 1. The racket frame is preferably made from a light weight tubular metal material such as aluminum or aluminum alloys. Other light weight and strong metals commonly used in fabricating metal tennis rackets are also suitable. The tubular aluminum structure is preferably bent to provide the desired tennis racket frame body 12. The tubular frame body as best shown in FIGS. 4 through 7 includes two parallel tubes 14 and 16 which are connected by an integral central member 18. The central member 18 includes an inside surface 20 and an outside surface 22. Typically, the tubular structure forming the frame body 12 is prepared by stamping aluminum tubes to the desired cross-sectional shape as shown in FIGS. 5 and 7. Other techniques for forming the tubes such as molding, extrusion or the like are possible.

The tubular structure is bent to form the frame body 12 so that a head portion 24, neck portion 26 and handle portion 28 are formed. In conventional rackets, in order to secure the tubular structures of the frame body 12 together, plastic, metal and other types of cross-brace members are provided in the neck 26 and the handle portion 28. These cross member supports are typically riveted or otherwise attached or bonded to the frame body 12.

In accordance with the present invention, a composite material jacket 30 is provided for reinforcing and structurally securing the frame body 12. The composite material jacket includes an inner layer 32 adjacent and bonded to the inside surface of the frame body. The composite material jacket 30 also includes an outer layer 34 adjacent and bonded to the frame body outside surface. As a particular feature of the present invention, the neck cross member support 36 is made from composite material which is integrally molded to the inner composite layer 32 as shown at 38 and 40. Further cross member supports 42, 44 and 46 are also provided. These further cross member supports are also made from composite material which is integrally molded to the inner composite layer 32. These supports are exemplary only and more or less supports in different configurations are possible. The important aspect is that the cross member supports be made from composite material which is compatible with the composite material of the inner composite layer 32 so that an integrally molded cross member support 36 may be provided connecting the inner composite layer 32 present on opposite sides of the neck 26 and handle 28 portions.

It should be pointed out that by providing cross member support 46 at the bottom of the tennis racket, the need for a separately mounted end cap is precluded. This provides an especially desirable end cap for the tennis racket handle which is shown in FIG. 1 in phantom at 48.

Figure 2:
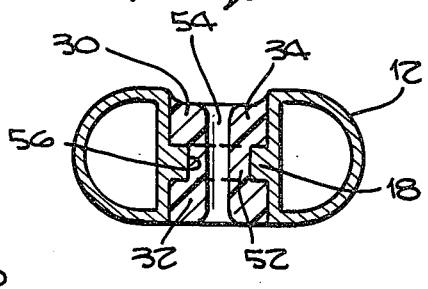
FIG. 2 is a sectional view of FIG. 1 taken in the II—II plane.
Figure 3:
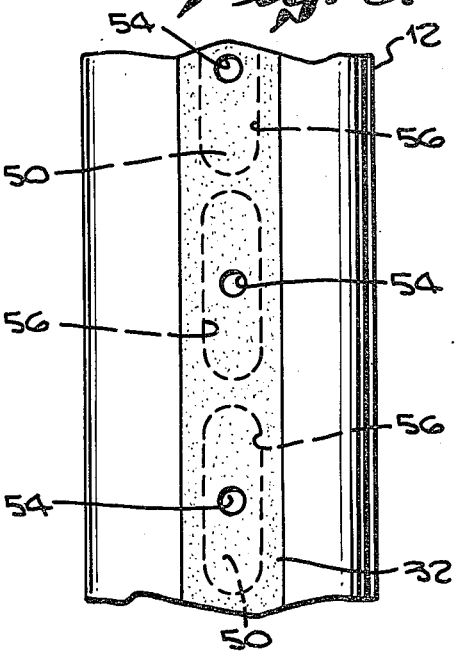
FIG. 3 is a view of FIG. 1 taken in the III—III direction.
Figure 4:
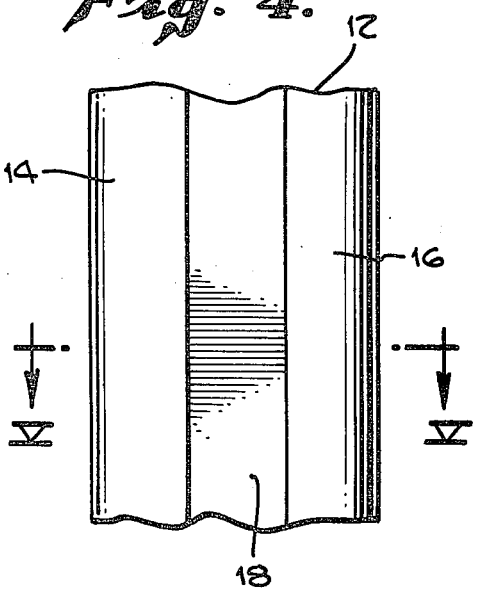
FIG. 4 is a view of a preferred tubular frame body without elongated slots.
Figure 6:
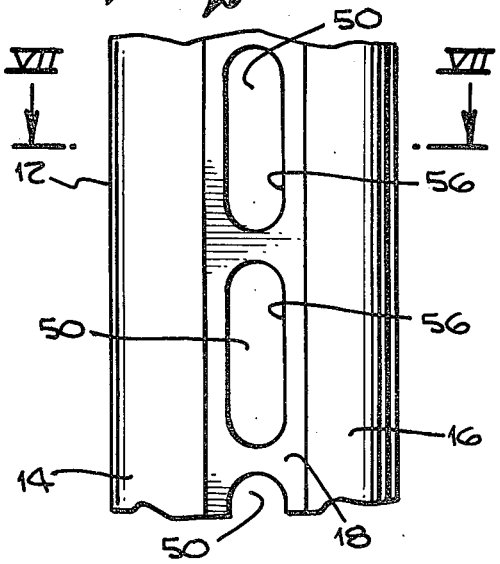
FIG. 6 is a view of a portion of a preferred tubular frame body having elongated slots therein.
Figure 5:
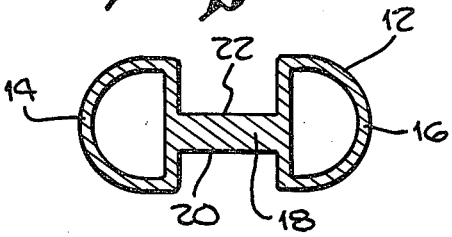
FIG. 5 is a sectional view of FIG. 4 taken in the V—V plane.
Figure 7:
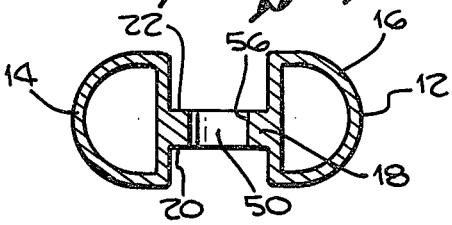
FIG. 7 is a sectional view of FIG. 6 taken in the VII—VII plane.

As shown in FIGS. 4 and 6, the central member 18 may be solid or it may include elongated slots 50. The elongated slots 50 provide an opening through which the inner composite layer 32 and outer composite layer 34 may be molded together to form an especially strong composite material jacket wherein the inner and outer composite material layers 32 and 34 are securely and integrally connected by composite material jacket ribs extending through the slots 50. As shown in FIG. 2, the outer composite layer 34 and inner composite layer 32 are integrally connected by a jacket rib 52 which extends through slot 50 and integrally connects the two composite layers together. The securing of the composite layers 32 and 34 by way of integral jacket ribs 52 through slots 50 serves a dual purpose. With regard to the racket head portion 24, racket string holes 54 may be provided passing through the composite layers 32 and 34 and jacket rib 52 to provide a means for mounting and securing the racket strings. The string holes 54 have a cross-sectional area less than the slots 50 as shown in FIG. 3 so that contact of the racket strings with the metallic surfaces 56 defining the slot 50 is prevented. The composite material through which string holes 54 is provided is smoother and provides a much more suitable mounting surface for racket strings than the sharp, jagged metal slot surfaces 56.

A second function served by the integral jacket ribs 52 is the increased structural strength provided by the integral ribbed connection of the outer composite layer 34 to the inner composite layer 32. This is especially important in the neck and handle portions where it is desirable to secure the cross member supports 36, 42, 44 and 46 to not only the inner composite layer 32 but also the outer composite layer 34. It is therefore preferred that the entire tubular frame body 12 be slotted as shown in FIG. 6. This allows formation of integral jacket ribs 52 between the outer composite layer 34 and inner composite layer 32 over the entire racket structure. Holes 54 are provided through slot 50 only at those locations on the head portion 24 which are necessary to provide desired racket string mounting locations. Of course, if desired holes 54 may be provided through slots 50 at any other location on the racket frame 10 to achieve desired aesthetic appearances or fine tuned weight distributions. It is preferred however that string holes 54 be provided in the head portion only. String holes are also provided through the neck cross member support 36 to allow complete rigging of the racket strings.

The composite material used to form the composite layers, connecting ribs and cross member supports may be made from any of the conventional resin coated composite filamentary materials such as graphite fiber, glass fiber, boron filaments, Kevlar filaments or any combination of these filamentary materials. The preferred composite material is graphite fibers either in woven sheets or filamentary form. Particularly well-suited are graphite fiber sheets having a resinous binder material impregnated therein. The resinous binder may be any of the well-known thermoplastic or thermosetting resins conventionally utilized in graphite fiber compositions. It is preferred that thermosetting resins such as phenolic resins, crosslinked polyesters and epoxy resins be used. A particularly preferred graphite fiber sheet composition can be constructed from Celion grade 6000 or Celion grade 12000 which is available from the Celanese Corp. and marketed under the name of Celion Graphite Fiber.

The graphite fibers for reinforcing tennis racket frames are preferably of medium modulus of elasticity. The modulus of these fibers ranges generally from about 30 million to about 40 million pounds per square inch. Although the diameter of the graphite filament may vary, it is preferred that they have an extremely fine diameter on the order of about 0.0003 inch. When an exceptionally high strength and stiffness composite jacket is desired, graphite fibers having a high modulus (i.e. 50 million to about 60 million pounds per square inch) may be utilized. The orientation of the graphite fibers in the composite jacket is preferably a configuration with the fibers aligned parallel relative the length of the tubular structure. Any number of layers may be utilized to obtain the desired composite layer thickness.

Figure 12:
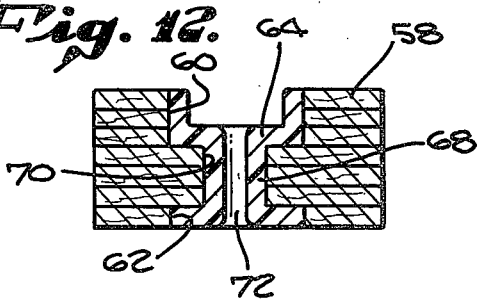
FIG. 12 is a sectional view of an exemplary frame body and composite material jacket wherein the frame body is made from wood.

As previously discussed, the present invention not only has application to tubular metal frame tennis rackets but also may be applied to other conventional tennis racket frame material. For example, FIG. 12 is a sectional view of the head portion of a wooden tennis racket. The wooden frame body 58 is grooved or otherwise machined to provide an outer groove 60 and an inner groove 62. In accordance with the present invention, an outer composite material layer 64 is molded into groove 60 and an inner composite material layer 66 is molded into groove 62 with an integral composite rib 68 connecting the two together. The rib 68 extends through a suitably provided elongated slot 70 passing through the racket frame 58. Further, since this sectional view is taken in the head portion of the wooden racket, wooden racket string holes 72 is provided for racket string mounting.

Figure 8:
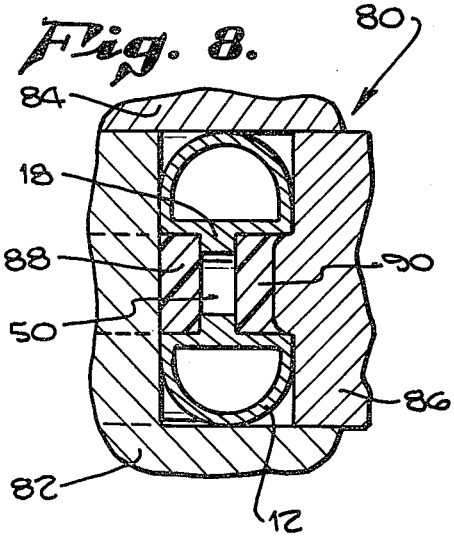
FIG. 8 is a sectional view of a portion of the frame body with uncured composite material in place prior to molding and curing of the composite material.
Figure 9:
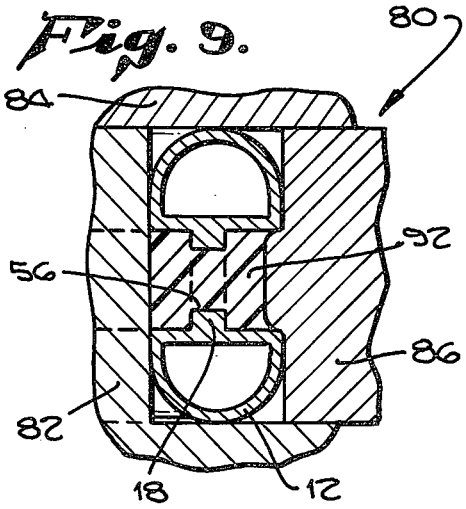
FIG. 9 is the same view as in FIG. 8 after the composite material has been cured to form the composite material jacket.
Figure 10:
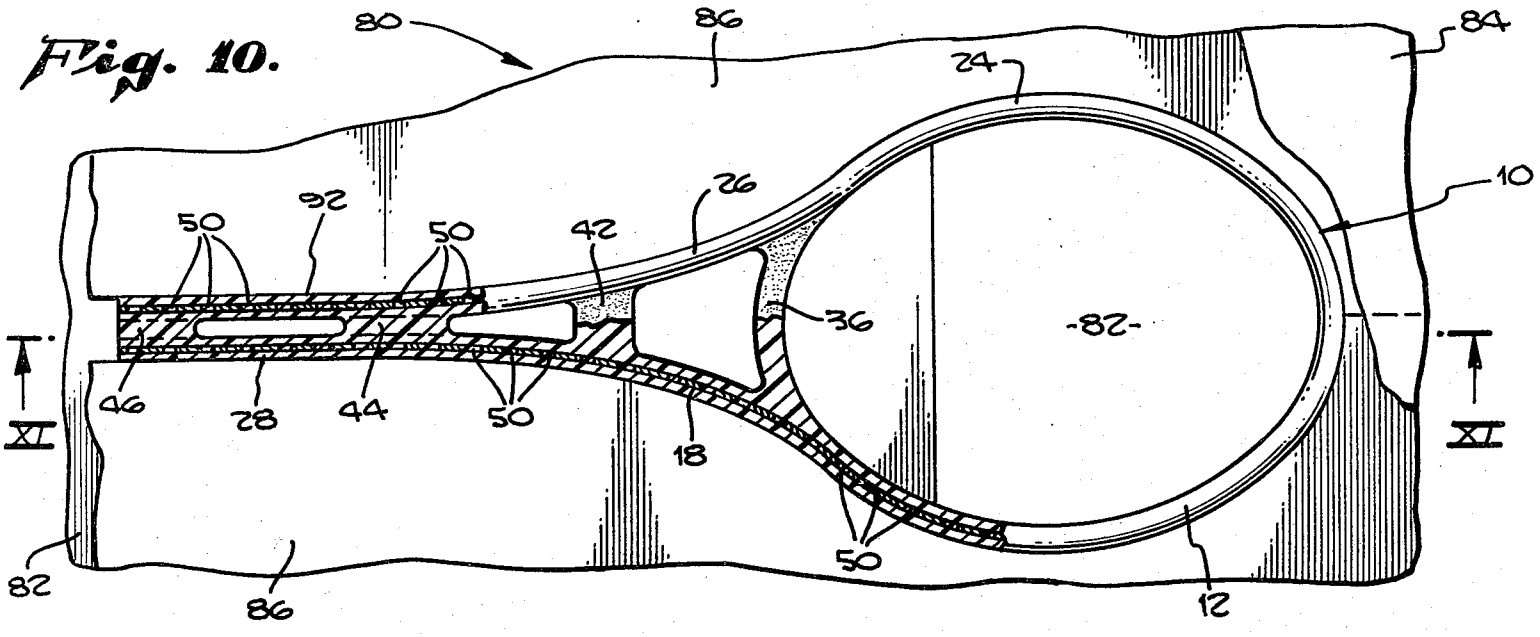
FIG. 10 is a partial sectional view taken in the X—X plane of FIG. 11.
Figure 11:
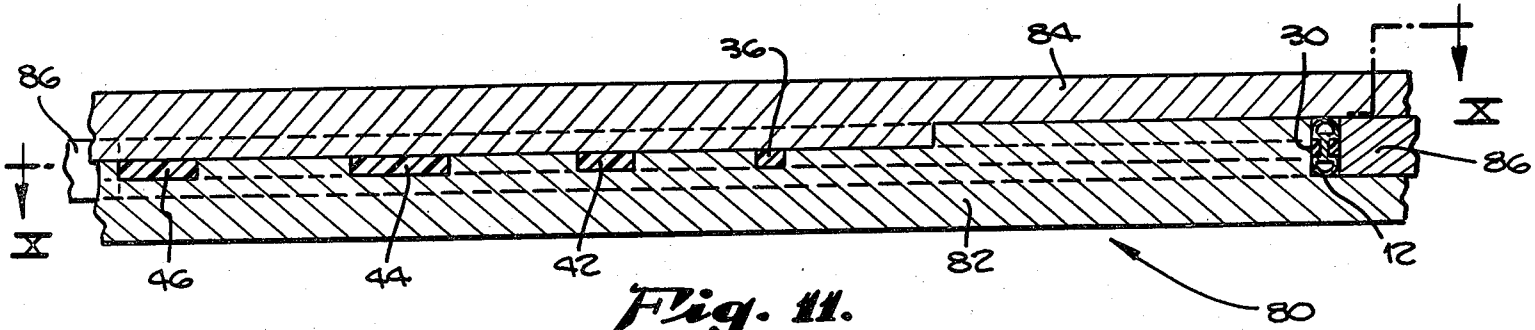
FIG. 11 is a sectional view of FIG. 10 taken in the XI—XI plane.

The composite material may be cured and bonded to the metal jacket frame structure by a wide variety of conventional techniques and processes. It is preferred that the frame body 12 be positioned in a suitable mold shown generally at 80 in FIGS. 8 through 11. The mold preferably includes a bottom plate 82, a top plate 84 and one or more side plates 86. As shown in FIG. 8, the uncured composite material 88 and 90 is positioned for molding on the inside and the outside of the frame body 12. The mold is then heated to conventional temperatures for curing the composite material with external pressure being applied by the side plate 86. For graphite composite material, the curing temperature is usually about 225 degrees F., to about 350 degrees F. The required pressure is usually on the order of 50 to 150 psi. The molding conditions are conventional. After a suitable period of time, the two composite layers 88 and 90 become cured and molded together to form the composite jacket shown in FIG. 9 at 92. Upon cooling, the mold is opened and the racket drilled and further processed to provide a finished product. FIGS. 10 and 11 show the entire frame body 12 as it is positioned in the mold after curing of the composite material jacket.

Having thus described exemplary embodiments of the present invention, it should be noted by those skilled in the art that the within disclosures are exemplary only and that various alternatives, adaptations and modifications may be made within the scope of the present invention. Accordingly, the present invention is not limited to the specific embodiments as illustrated herein.

What is claimed is:

1. A frame structure adapted for use as a tennis racket comprising:

a tubular frame in the shape of a racket, said racket having a handle, yoke and head, said frame including interior, exterior and side surfaces and having first and second end portions adjacent and parallel each other to form the racket handle, a semi-circular central portion forming the racket head and first and second mid portions located between the racket handle and racket head to form the racket yoke wherein said first and second mid portions diverge from each other from the racket handle to the racket head to form an open space between said mid portions where they join said central portion;

a plurality of surfaces defining elongated slots in said frame passing from said exterior frame surface to said interior frame surface, said slots being located at spaced locations in the racket handle, yoke and head a unitary composite material racket support frame having an outer rim extending continuously around and adjacent to the frame exterior surface from said first end portion to said second end portion, an inner rim extending continuously around and adjacent to the frame interior surface from said first end portion to said second end portion, and a plurality of integral ribs extending through said elongated slots and joining said outer rim to said inner rim at the racket handle, yoke and head, said racket support frame further including one or more spaced integral support bars located in the racket handle and yoke and extending between and joining the inner rim of said support frame, wherein one of said support bars provides a string mounting and racket support bar integral with said inner rim and extending across said open space between said inner rim where said frame mid portions join the frame central portion, said string mounting and racket support bar including a plurality of surfaces defining spaced holes adapted for mounting racket string;

a plurality of surfaces defining holes adapted for mounting racket string extending through said inner rim, outer rim and integral rib, said holes passing laterally through the elongated slots in said frame central portion.

2. A frame structure according to claim 1 wherein said frame body is made from a material selected from the group consisting of metal, wood and plastic.

3. A frame structure according to claim 1 wherein said composite material is selected from the group of resin impregnated fibers consisting of boron, graphite, polyamide aramid and glass fibers.

4. A frame structure according to claim 3 wherein said composite material includes more than one type of said resin impregnated fibers.

5. A frame structure according to claim 1 said composite material is resin impregnated graphite fibers.

6. A frame structure according to claim 1 wherein said composite material is resin impregnated graphite fibers having a modulus of elasticity between 30 and 60 million pounds per square inch.

7. A frame structure according to claim 1 wherein said resin impregnated graphite fibers include resin from the group consisting of phenolic and epoxy resins.

8. A frame structure according to claim 1 wherein said tubular frame comprises two parallel tubes connected by an integral flat central member having inside and outside surfaces, said inner rim being located adjacent said inside surface and said outer rim being located adjacent said outside surface.

9. A frame structure according to claim 1 wherein said racket support frame is a single piece unitary structure.

10. A frame structure according to claim 9 wherein said racket support frame is formed by molding said racket support frame onto said tubular frame.

* * * * *